United States Patent [19]

Bertolino

[11] 4,145,825

[45] Mar. 27, 1979

[54] PLOW WINGS

[76] Inventor: Emanual Bertolino, 8 Lafayette Ave., West Haverstraw, N.Y. 10993

[21] Appl. No.: 861,399

[22] Filed: Dec. 16, 1977

[51] Int. Cl.[2] ..... E01H 5/04; A01B 33/00

[52] U.S. Cl. ..... 37/42 VL; 172/113

[58] Field of Search ..... 37/42 R, 42 VL, 41, 37/50; 172/4.5, 225, 803, 807, 113

[56] References Cited

U.S. PATENT DOCUMENTS

| | | | |
|---|---|---|---|
| 2,713,220 | 7/1955 | Muenchow | 37/42 R |
| 2,964,862 | 12/1960 | Lotz | 37/50 |
| 2,988,831 | 6/1961 | Burns | 37/50 |
| 3,125,818 | 3/1964 | Kraft et al. | 37/42 R |
| 3,208,166 | 9/1965 | Proulx | 37/42 R |
| 3,216,337 | 11/1965 | MacDonald | 37/50 X |
| 3,231,991 | 2/1966 | Wandscheer et al. | 37/42 VL |
| 3,279,104 | 10/1966 | Wandscheer et al. | 37/42 VL |
| 3,604,517 | 9/1971 | Clifford | 37/42 X |
| 3,805,424 | 4/1974 | Renahan | 37/42 VL |
| 3,831,689 | 8/1974 | Smith | 37/42 VL |

FOREIGN PATENT DOCUMENTS

| | | | |
|---|---|---|---|
| 539486 | 4/1957 | Canada | 37/50 |
| 2164524 | 6/1973 | Fed. Rep. of Germany | 37/42 VL |

*Primary Examiner*—E. H. Eickholt

*Attorney, Agent, or Firm*—James J. Cannon, Jr.; James J. Cannon

[57] ABSTRACT

A plow wing for mounting on each side of a snow plow blade and adjustable by the snow plow operator to permit the snow pushed by a plow to move in a direction determined by the operator. When not in use, the wings are retracted rearward so that they will not interfere with normal plowing. The purpose of the wings is to prevent the accumulation of snow in an area which must be cleared, such as walls and sides of bridges abutting traffic lanes and driveways. The plow blade is driven hydraulically and the wings are connected to said plow blades by mating L-shaped members. One set of cables and springs is used to move each wing to its non-operative position. A second set of cables, springs and pulleys serves to move either or both wings to their operative position under the control of the plow operator.

4 Claims, 6 Drawing Figures

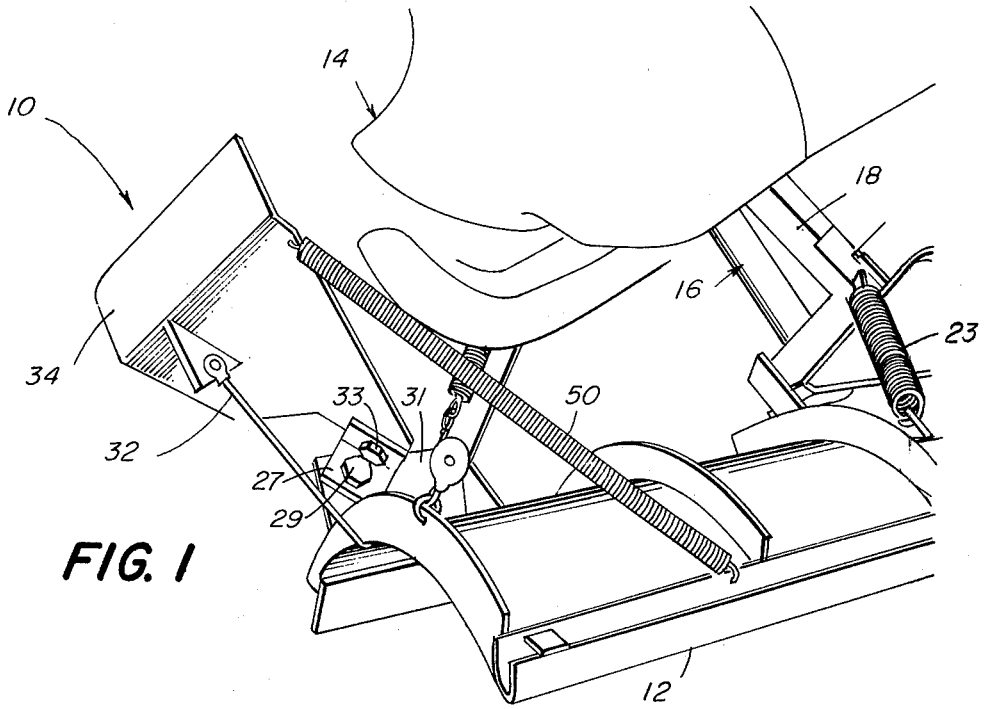
FIG. 1
FIG. 4
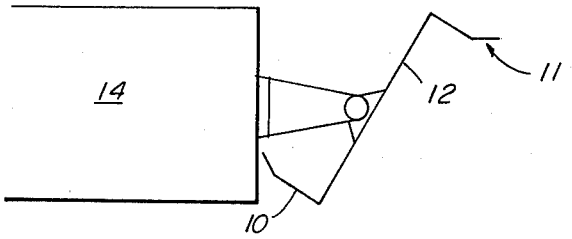
FIG. 5
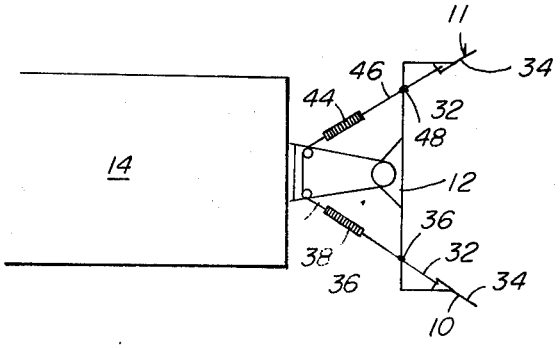
FIG. 6
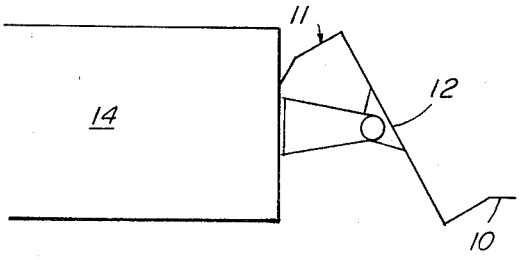

10
11
20
22
23
24
25
26
27
28
29
31
32
33
34
36
38
40
42
44
46
48
50
52
54
56
58
60
62
64

PLOW WINGS

BACKGROUND OF THE INVENTION

1. Field of the Invention

This invention pertains to roadway snow excavators and in particular to vehicle-mounted snow plows having diagonal blades and track clearing means.

2. Description of the Prior Art

The prior patent are has numerous references to snow plow blades having wings or various anti-spill devices, such as those disclosed in U.S. Pat. Nos. 2,964,864, and 3,604,517. There are also a number of prior patents on raised plow wings which serve to lower the height of snow blanks along a road side by utilizing a wing to push the upper portion of the snow bank further from the road edge.

There is only one prior U.S. Patent known to the inventor which discloses a plow wing usable for removing the ridge or bank of snow which accumulates along a road surface adjoining a wall or similar structure which prohibits the snow to be pushed beyond the edge. U.S. Pat. No. 3,231,991 discloses a snow ridge scraper wing attachment for a plow which may be raised from and lowered to its operative position by hydraulic means.

The purpose of the present invention is to provide a very simple and inexpensive plow wing for each side of a plow blade which is simple to use and which pivots rearwardly behind the plow blade when not in use. The design of the present invention works in conjunction with the hydraulic system required for the plow mechanism and does not require a separate hydraulic system.

SUMMARY OF THE INVENTION

The invention pertains to wings for a snow plow blade for preventing the accumulation of snow along the inside edges of roadways which abut walls or similar structures. The wing causes the snow to be pushed forward rather than be piled in a ridge. In this invention, two vertically oriented plow wings are pivotally secured to the curved ends of the plow blade of a conventional hydraulically operated plow such that one wing is mounted at each end of the plow blade perpendicular to the longitudinal axis thereof. When a wing is in its operative position, it encloses the open end of the curved plow blade and has a tapered outward angular extension which extends forward of the plow blade and when it is in its non-operative position it is perpendicularly rearward of said blade. In moving from the operative position to the non-operative position, each wing pivots through an arc of about 180 degrees. In the present invention the combination of two wings will result in three operative positions. These will be described with reference to a hydraulically operated plow mounted on the front end of a vehicle which moves forward to plow, the direction of the plow blade being controlled by dual hydraulic cylinders. If an abutment exists only on the left side of the road and the operator can pile snow on the right side of the road, the left hydraulic cylinder will have its piston fully extended, the right hydraulic cylinder will have its piston fully retracted, causing the plow blade to be angularly disposed to the right, and causing the right wing to be pivoted rearwardly to its non-operative position and the left wing to be pivoted forwardly to its operative position. If abutments exist on both sides of the roadway and the operator cannot plow snow to either side, the piston of the left reciprocal hydraulic cylinder is retracted to its midpoint, the piston of the right hydraulic cylinder is extended to its midpoint, causing the plow blade to be positioned parallel to the lateral axis of the vehicle and perpendicular to the direction of travel, and causing both plow wings to be in their forward operative positions. If an abutment exists on the right side of the roadway and the operator can pile snow on the left side, the piston of the left hydraulic cylinder is fully retracted, the piston of the right hydraulic cylinder is fully extended, causing the plow blade to pivot counter-clockwise and to be angularly disposed to the left, and causing the left wing to be pivoted rearwardly to its non-operative position and the right wing to be pivoted forwardly to its operative position.

The plow wings are caused to pivot in conjunction with the pivotal motion of the plow blade through sets of cables, pulleys and reciprocally operating springs. A first set serves to pivot the plow wings rearwardly to their non-operative positions. A cable is secured to the inner side of the wing, the outside in the retracted position, proceeds around the edge of the plow blade, through an aperture in the plow blade to a spring positioned in the horizontal plane. A second cable connected to the opposite end of this spring proceeds angularly rearward to the plow mounting frame, around two pulleys and then angularly toward a second horizontally oriented spring to which it is connected. The other end of said second spring is connected to a third cable which proceeds through an aperture in the plow blade, to the inner side of the opposite plow wing to which it is similarly secured. This set of wires, springs and pulleys is used to pivot the wings rearward to their non-operative position. It is assisted by a spring secured to the top of the wing near one end and to the top of the plow blade at the other end. When the plow blade is turned clockwise, the left springs will be taut, the right springs will be loose, resulting in the left wing staying in an operative position and the right wing being pivoted to a non-operative position, assisted by the top spring. A second set of cables, springs and pulleys is used to pivot the wings forwardly to their operative position. This set consists of two parallel, reciprocally operating sets, one of which controls each wing. A chain is attached to the outer face of the wing and proceeds in a horizontal direction around the wing and the rear of plow blade where it is connected to a cable which passes diagonally rearward and through two spaced apart pulley blocks on the plow mounting frame and then diagonally forward through a pulley mounted on the opposite end of the rear of the plow blade and then is connected to an elongated spring which is stretched diagonally rearward to the plow mounting frame. The other wing is controlled by a second, similar but opposed set.

When the plow blade is pivoted clockwise, all springs on the left side become extended and all springs on the right side become relaxed, resulting in the left wing being pivoted to its operative position and the right wing being pivoted to its non-operative position. The reverse action happens when the plow blade is pivoted counter-clockwise. When the plow blade is positioned forward for straight plowing, there is equal tension on all the springs and the two plow wings remain in their operative positions.

BRIEF DESCRIPTION OF THE DRAWINGS

FIG. 1 is a side perspective view of a plow wing of the present invention in its non-operative position.

FIGS. 4, 5 and 6 are diagrammatic views of the three normal operating positions of the plow wings of this invention.

DESCRIPTION OF THE PREFERRED EMBODIMENT

Figures 2, 3:
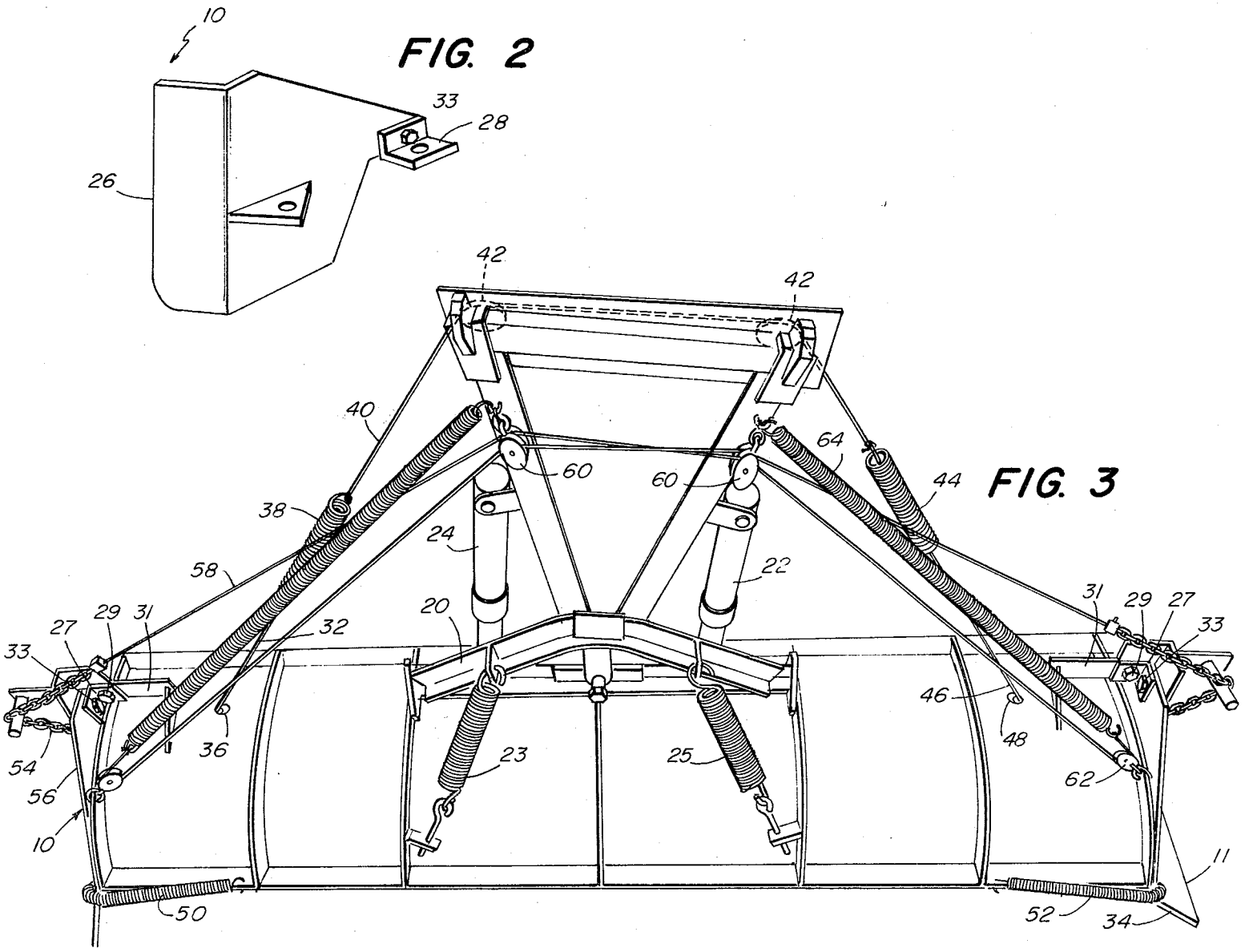
FIG. 2 is a plan view of a plow wing.
FIG. 3 is a rear perspective view of the spring, cable and pulley assembly which operates the plow wings of this invention.

Referring now to the drawings, FIG. 1 is a side perspective view which illustrates the plow wing 10 of the present invention as pivotally mounted on a plow blade 12 and in its non-operative position. Plow blade 12 is mounted, in the embodiment illustrated, to the front end of vehicle 14 by means of a conventional mounting assembly 16. Mounting assembly 16, shown in greater detail in FIG. 3, includes a pair of generally V-shaped brackets 18, 20(FIG. 3) pivotally secured to each other and a pair of reciprocally operating hydraulic cylinders 22, 24 (FIG. 3) and a pair of springs 23, 25 to connect the plow blade 12 to V-shaped bracket 20 to provide for the pivotal movement of plow blade 12. FIG. 1 also show the means by which plow wing 10 is mounted to plow blade 12. An L-shaped bracket 27 is secured by bolt 29 to plate 31 mounted the rear of plow blade 12 such that plow wing 10 may pivot about the shaft of bolt 29 in the horizontal plane. L-shaped bracket 27 is further attached to plow wing 10 by bolt 33 such that plow wing 10 may pivot vertically upward about the shaft of bolt 33 if plow wing 10 should hit an obstruction.

Referring now to FIG. 2, plow wing 10 is of a generally trapezoidal shape such that it fits snugly along the curved edge of plow blade 12 when it its operative position. The outward angular extension of plow wing 10 extends beyond the leading edge of plow blade 12, and that portion of plow wing 10 which so extends is bent outward at an angle of about thirty degrees. Thus, when plow blade 12 is pivoted to the left or to the right, the leading edge 26 of operative plow wing 10 is parallel to the direction of travel. Plow wing 10 also includes mounting brackets 27 which are received by mounting plate 31 secured to plow blade 12 to provide for pivotal movement of plow wings 10 is there illustrated. This means includes two sets of cables, springs and pulleys, and one set to pivot the plow wings 10 to their non-operative position and one set to pivot them to their operative position. For purposes of this specification the right plow wing will have the reference numeral 10 and the left wing will have the reference numeral 11.

When a wing 11 is in its operative position, (FIG. 4), it is perpendicularly forward of the plow blade 12 and when it is in its non-operative position it is perpendicularly rearward of said blade. In moving from the operative position to the non-operative position, each wing 10, 11, pivots through an arc of about 180 degrees. In the present invention the combination of two wings 10, 11, will result in three operative positions. These will be described with reference to a hydraulically operated plow 12 mounted to the front end of a vehicle 14 which moves forward to plow, the direction of the plow blade 12 being controlled by dual hydraulic cylinders 22, 24. If an abutment exists only on the left side of the road and the operator can pile snow on the right side of the road, the left hydraulic cylinder 22, will have its piston fully extended, the right hydraulic cylinder 24 will have its piston fully retracted, causing plow blade 12 to be angularly disposed to the right, and causing the right wing 10 to be pivoted rearwardly to its non-operative position and the left wing 11 to be pivoted forwardly to its operative position, as shown in FIG. 4. If abutments exist on both sides of the roadway and the operator cannot plow snow on either side, the piston on the left reciprocal hydraulic cylinder 22 is retracted to its midpoint, the piston on the right hydraulic cylinder 24 is extended to its midpoint, causing the plow blade 12 to be positioned parallel to the lateral axis of the vehicle 14 and perpendicular to the direction of travel, and causing both plow wings 10, 11 to be in their forward operative positions as shown in FIG. 5. If an abutment exists on the right side of the roadway and the operator can pile snow on the left side, the piston of the left hydraulic cylinder 22 is fully retracted, the piston of the right hydraulic cylinder 24 is fully extended, causing the plow blade 12 to pivot counter-clockwise and to be angularly disposed to the left, and causing the left wing 11 to be pivoted rearwardly to its non-operative position and the right wing 10 to be pivoted forwardly to its operative position, as shown in FIG. 6.

The plow wings 10, 11 are caused to pivot in conjunction with the pivotal motion of the plow blade 12 through sets of cables, pulleys and reciprocally operating springs. A first set serves to pivot the plow wings 10, 11 rearwardly to their non-operative positions. A cable 32 is secured to the inner side 34 of the wing 10, the outside in the retracted position, and proceeds through an aperture 36 in the plow blade 12 to a spring 38 positioned behind plow blade 12 in the horizontal plane. A second cable 40 connected to the opposite end of spring 38 proceeds angularly rearward to the plow mounting frame 16, around two pulleys 42 and then angularly toward a second horizontally oriented spring 44 to which it is connected. The other end of said spring 44 is connected to a third cable 46 which proceeds through a second aperture 48 in the plow blade 12 to the opposite plow wing 11 to which it is similarly secured. This set of cables, springs and pulleys is used to pivot the wings 10, 11, rearward to their non-operative position. It is assisted by springs 50, 52, secured to the top of the wings 10, 11, at one end and to the top of the plow blade 12, at the other end. When the plow blade 12 is turned clockwise, the left spring 38 will be taut, the right spring 44 will be loose, resulting in the left wing 11 staying in an operative position and the right wing 10 being pivoted to a non-operative position, assisted by the top spring 52.

A second set of cables, springs and pulleys is used to pivot the wings 10, 11, forwardly to their operative position. This set consists of two parallel, reciprocally operating sets, one of which controls each wing. A chain 54 is attached to the outer side 56 of the wing 10 where it proceeds in a horizontal rearward direction around wing 10 and plow blade 12 where it is connected to a cable 58 which passes diagonally rearward and through two spaced apart pulley blocks 60 on the plow mounting frame 16 and then diagonally forward through a pulley 62 mounted on the opposite end of the rear side of plow blade 12 and then is connected to a elongated spring 64 which is stretched diagonally rearward to plow mounting frame 16. The other wing 11 is controlled by a similar but opposed set.

When the plow blade 12 is pivoted clockwise, all springs on the left side become extended and all springs on the right side become relaxed, resulting in the left wing 11 being pivoted to its operative position and the right wing 10 being pivoted to its non-operative position. The reverse action happens when the plow blade 12 is pivoted counter-clockwise. When the plow blade 12 is positioned forward to straight plowing, there is equal tension on all the springs and the two plow wings 10, 11, remain in their operative positions.

The plow wing described herein is inexpensive to manufacture, simple to install, even when retrofitted to an existing plow blade, and is very simple to use. It requires no additional controls, but is operated by the directional movement of the hydraulically operated plow blade. No additional hydraulic cylinders are required.

While I have described and illustrated the preferred embodiment of my invention, it should be understood that all variations within the scope and spirit of the appended claims are to be included.

I claim:

1. A plow wing for attachment to the side edges of a hydraulically operated plow blade mounted to a vehicle by a pivoting plow mounting frame comprising:

a generally trapezoidal shaped plow wing shaped to enclose the open end of a curved plow blade and having its larger, leading portion bent angularly outward and forward of said plow blade;

means to pivotally mount one of said plow wings to each side of a plow blade such that said plow wing may pivot horizontally through an arc of one hundred and eighty degrees from a non-operative to an operative position, and vertically to avoid obstructions;

means to move said plow wings from their operative positions to their non-operative positions consisting of cables, reciprocal springs and springs and pulleys;

means to move said plow wings from their non-operative positions to their operative positions consisting of cables, reciprocal springs and pulleys.

2. The plow wings of claim 1 wherein said means to mount said plow wing to said plow blade further includes:

An L-shaped mounting bracket on the trailing edge of said plow wing adapted to be received by a horizontal plate, the base of said bracket being secured to said plate by a nut and bolt such that horizontal pivotal movement is possible;

a horizontal plate secured to the rear edge of said plow blade and adapted to receive said nut and bolt; and the upward leg of said bracket being secured to said plow wing by a nut and bolt, such that vertical pivotal movement is possible.

3. The plow wing of claim 1 wherein said means to move said plow wing from its operative position to its non-operative position further includes:

a first cable secured at one end of the inner surface of a first plow wing and proceeding diagonally rearward through an aperture in said plow blade to a first spring:

a first spring secured at one end to said first cable and at its other end to a second cable;

a second cable secured to one end of said first spring and extending rearward to a pair of pulleys mounted on said plow frame and proceeding diagonally forward to a second spring;

a second spring connected at one end to said second cable and at its other end to a third cable;

a third cable connected to said second spring and proceeding diagonally forward through a second aperture in said plow blade and secured to the inner side of a second plow wing mounted on the other end of said plow blade;

a pair of springs each connected at one end to the upper edge of said plow blade and at its other end to the upper edge of the leading edge of one of said plow blades.

4. The plow wing of claim 1 wherein said means to move said plow wing from its non-operative position to its operative position further includes:

a chain secured to the outer surface of said plow blade and proceeding rearward around the edge of said plow blade;

a cable secured at one end to said chain and proceeding diagonally rearward through a first pulley on said mounting frame, proceeding laterally through a second pulley on said mounting frame, then proceeding diagonally forward to and through a pulley mounted on the rear of said plow blade on its opposite edge, and then connected to a spring;

a spring connected at one end to said cable and at its opposite end to said plow mounting frame.

* * * * *